US005782412A

United States Patent [19]

Plantz et al.

[11] Patent Number: 5,782,412

[45] Date of Patent: Jul. 21, 1998

[54] GARDEN WATERING TOOL

[75] Inventors: Jeffrey S. Plantz, Seven Hills; John R. Nottingham, Hunting Valley; John W. Spirk, Gates Mills; Paul E. Brokaw, Euclid; Paul A. Tamulewicz, Berea, all of Ohio

[73] Assignee: Gulfstream Home & Garden, Inc., Lexington, Ky.

[21] Appl. No.: 508,626

[22] Filed: Jul. 28, 1995

[51] Int. Cl.[6] ..... B65H 75/00; B65H 75/34; B65H 75/38

[52] U.S. Cl. ..... 239/197; 239/198; 137/355.2; 137/355.26; 242/397.3; 242/405.3

[58] Field of Search ..... 239/195, 197, 239/198, 273, 586; 242/395, 395.1, 397.3, 397.4, 402, 405.3, 596.8, 599.3; 137/355.16, 355.2, 355.26

[56] References Cited

U.S. PATENT DOCUMENTS

| | | | |
|---|---|---|---|
| 640,878 | 1/1900 | Curley | 239/586 |
| 669,845 | 3/1901 | Melavin | 239/586 |
| 3,936,002 | 2/1976 | Geberth, Jr. | 239/586 X |
| 4,022,398 | 5/1977 | Youngblood | 242/395 |
| 4,078,764 | 3/1978 | Haffner . | |
| 4,506,698 | 3/1985 | Garcia et al. | 137/355.26 |
| 4,512,361 | 4/1985 | Tisbo et al. | 137/355.27 |
| 4,513,772 | 4/1985 | Fisher | 242/397.3 X |
| 4,537,215 | 8/1985 | Roman | 242/405.3 X |
| 4,586,676 | 5/1986 | Johnston et al. | 242/86 |
| 4,974,627 | 12/1990 | Nelson | 137/355.2 X |
| 5,320,281 | 6/1994 | Hartmann et al. | 239/154 |

FOREIGN PATENT DOCUMENTS

| | | | |
|---|---|---|---|
| 63-242871 | 3/1987 | Japan | 242/405.3 |
| 6-100247 | 4/1994 | Japan | 242/397.3 |

*Primary Examiner*—Andres Kashnikow
*Assistant Examiner*—Robin O. Evans
*Attorney, Agent, or Firm*—Vickers, Daniels & Young

[57] ABSTRACT

A garden watering tool comprising a hose reel and integral nozzle is disclosed. The reel is provided with a short length of hose which is connected to the nozzle and a long length of hose which is contained upon a reel and can easily be pulled out and reeled in. The long length of hose is to be connected to a faucet and the tool carried to the location of use.

47 Claims, 7 Drawing Sheets

GARDEN WATERING TOOL

BACKGROUND OF THE INVENTION

This invention pertains to tool for watering garden plants and the like and more particularly to a combined hose, reel and sprayer for use in watering plants and the like.

Gardening, both indoor and outdoor, provides pleasure to millions of people. For some, gardening consists of one or more plots of cultivated soil in the yard. For others, gardening is an indoor activity. Either a greenhouse or a potted plant near a window forms the garden. Plants in indoor gardens and outdoor gardens require water. Numerous tools have been provided in the past to allow a gardener to apply water as required.

Garden hoses of various lengths and internal diameters of about ½ to ¾ inch, can provide a great deal of water. They are useful in large outdoor gardens but they are heavy and hard to handle. Watering cans having sprinkling heads are also available. They provide only a limited amount of water and are also heavy. The difficulty of conveying water to garden plots, shrubbery, decorative flowers and indoor potted plants has long been recognized. Numerous attempts to ease the problem have been proposed.

One successful approach is the garden hose reel. A standard garden hose of ½ or ⅝ inch internal diameter is provided on a reel with a handle. A controllable nozzle is placed on one end of the hose and the other end of the hose is connected to the hub of the reel which in turn is connected to a short (about five feet) length of hose. The short length of hose is connected to a garden faucet. The long hose can be fed off the reel to a desired length. Water can be applied to the desired location and the long hose reeled up. Problems still remain however. The hose must be pulled off the reel, usually when it is full of water. It is heavy. Moreover, once it is pulled off it must be dragged around obstacles and used. When finished, the hose must be taken up at the reel station. As the hose is full of water and heavy, this take up is difficult, tiring, and sometimes injures the hose which may be snagged around an obstacle. Numerous hose reels have been made available in the past. One such hose reel is described in U.S. Pat. No. 4,512,361 which illustrates the principal components described above.

Another approach taken has been the use of collapsible hoses. Such hoses are lighter than standard garden hoses; however, they must be completely unwound to be used and emptied of water to be wound.

Another approach more suited to indoor plant watering is the provision of a small diameter plastic tube which can be connected to a kitchen faucet and which has a nozzle on its other end. Such products cannot be conveniently stored as they are not normally provided on a reel. Even if such small diameter tubes are rolled up, they have a tendency to compress limiting their ability to deliver water. If they are rolled around a core of some kind, overlying layers of tube will often be pulled into underlying layers causing tangling, compression, and kinks. Generally, the tube must be completely unwound before use.

Another problem with all of the above described approaches is the potential for mess. When one is finished with the hose one needs to put it away. This usually involves coiling or reeling in the hose. As this is done, the hose will often discharge water from the nozzle wetting whatever is in the way. This is often the person coiling the hose. The problem is exaggerated with indoor plants or when a hose is used for an indoor activity other than plant watering. Coiling up the hose can result in water being sprayed on furniture, on guests, on pets, and other unintended recipients.

Thus, many of the currently available tools suffer from one or more of the following problems: They are heavy, they are difficult to use, they are messy, they are difficult to store, they are expensive, and they are generally inconvenient.

SUMMARY OF THE INVENTION

The present invention provides a watering tool which is relatively light in weight, convenient to use, provides an adequate flow of water, and has means to control unintended water leakage.

In accordance with the present invention, a watering tool is provided having a reel housing with a short length of hose attached to the housing, a long length of hose coiled on a spool within the housing, and a nozzle attached to the end of the long length of hose.

Further in accordance with the invention, both the short length and long length of hose are of relatively small diameter whereby the reel and hose can be carried even if filled with water.

Yet further in accordance with the present invention, the housing is provided with a reciprocating hose guide geared to the spool which causes the hose to be taken up on the spool in an orderly manner preventing kinking, collapsing, and tangling.

Still further in accordance with the present invention, the hose reel is provided with a nozzle retaining slot at the top of the housing which receives the nozzle with the water discharge opening contained within a receptacle.

Yet further in accordance with the invention, the nozzle receptacle on the housing is adapted to accept drips and/or leaks from the nozzle tip and direct them to the bottom of the housing for drainage in a downward direction.

Still further in accordance with the present invention, the housing is provided with an aperture near the top of the housing and above the main body of the spooled long length of hose which aperture receives the end of the long length of hose whereby water will not drain from the long length of hose when it is disconnected from a faucet.

Still further in accordance with the present invention, the housing is provided with a conical bearing surface on one inside surface forming part of a large diameter roller bearing and a recess receiving a nylon bushing on the other side of the housing whereby the spool is supported in a low-friction, centered arrangement, easing wind up of the long length of hose.

Yet further in accordance with the invention, the nozzle is provided with a valve regulating flow which makes the valve easily manipulated by the thumb.

Still further in accordance with the invention, both the long length of hose and the short length of hose are provided with female hose connector connections whereby the nozzle can be employed on either the long length of hose or the short length of hose.

Yet further in accordance with the invention, a bushing attaching the female connector to the hose is resilient whereby the end of the hose is snap retained in the aperture of the housing.

Still further in accordance with the invention, the nozzle retaining means on the top of the housing accepts the nozzle with the water discharge opening pointing in a direction opposite to the direction of discharge of the long length of hose.

The principal object of the invention is the provision of a new and improved garden tool which conveniently allows one to water plants at a distance from a faucet.

It is another object of the present invention to provide a hose reel which can be easily carried from point to point even when filled with water and connected to a faucet.

It is still another object of the present invention to provide a hose reel which will automatically discharge hose behind the user while being carried to the point of use and conveniently provide the user with a nozzle on the short length of hose for use at the location desired.

It is still another object of the present invention to provide a hose carrier which has a spool which is easily turned to wind up the hose for storage.

It is still another object of the present invention to provide a hose carrier which winds up a hose in an orderly manner preventing kinks, tangles, and knots.

It is still another object of the present invention to provide a hose carrier which minimizes the chance of accidental discharge of water onto unintended surfaces and things.

It is yet another object of the present invention to provide a hose carrier having hose end retaining means positioning the hose ends near the top of the carrier whereby water will not siphon out of the hose ends.

It is still another object of the invention to provide a low-friction hose carrier spool allowing the wind up of hose without the need of undue force.

It is still another object of the present invention to provide an appliance having 50 ft. or more of hose available in a lightweight container for use in gardening and the like.

These and other objects and advantages of the invention will become apparent from the following detailed description when read in conjunction with the drawings which form a part hereof.

BRIEF DESCRIPTION OF DRAWINGS

FIG. 8 is an exploded view of the nozzle attached to the hose reel; and

FIG. 9 is an exploded view of the hose showing the connector assembly contained within the hub of the reel shown in FIGS. 1–8.

Referring now the drawings wherein the showings are made for the purposes of illustrating a preferred embodiment of the invention only and not for the purposes of limiting same, FIG. 1 shows a garden watering tool 10 comprised of a housing 12, a reel 14, a short hose 16, a long hose 18, and a nozzle 20. Both the short hose 16 and the long hose 18 have an internal diameter of ¼ inch and are a multilayer of hoses with a braided reinforcing fiber layer over their entire lengths. This provides a hose of sufficient strength to be wound upon the reel 14 without collapsing. The hose can therefore carry water while a portion of its length is still coiled around reel 14. The end of the long hose 18 is provided with a female hose connector 22 and a strain relief spring 23. The hose connector 22 is shown in the disassembled state in FIG. 9. The hose connector 22 comprises a short inner tubular element 24, an outer tubular element 26, and a threaded cup 28. The inner tubular element 24 has an enlarged shoulder portion 32. The outer tubular element 26 also has an enlarged shoulder portion 34. The outer tubular element 26 fits snugly around the outside of the hose 18. The inner tubular element 24 passes through an aperture 36 in the threaded cup 28 and into the hose 18 which is captured between the inner tubular element 24 and the outer tubular element 26. The inner tubular element 24 is provided with threads 25 which tightly grip the hose 18. The shoulder 32 on the inner tubular element 24 is larger than the aperture 36 in the cup 28. The connector is thereby securely fixed to the end of the hose 18. Importantly, the shoulder 34 and the cup 28 can flex to a limited degree with respect to one another. Referring again to FIG. 1, the hose connector is retained in an aperture 38 in the housing 12. The aperture has a height slightly smaller than the distance between the end of the connector 22 and the shoulder 34. When the connector and shoulder are placed in the aperture 38, the shoulder 34 is flexed upwardly and the connector 22 is held in the aperture by this spring action against a tab 40 at the top of the aperture 38.

Figure 1:
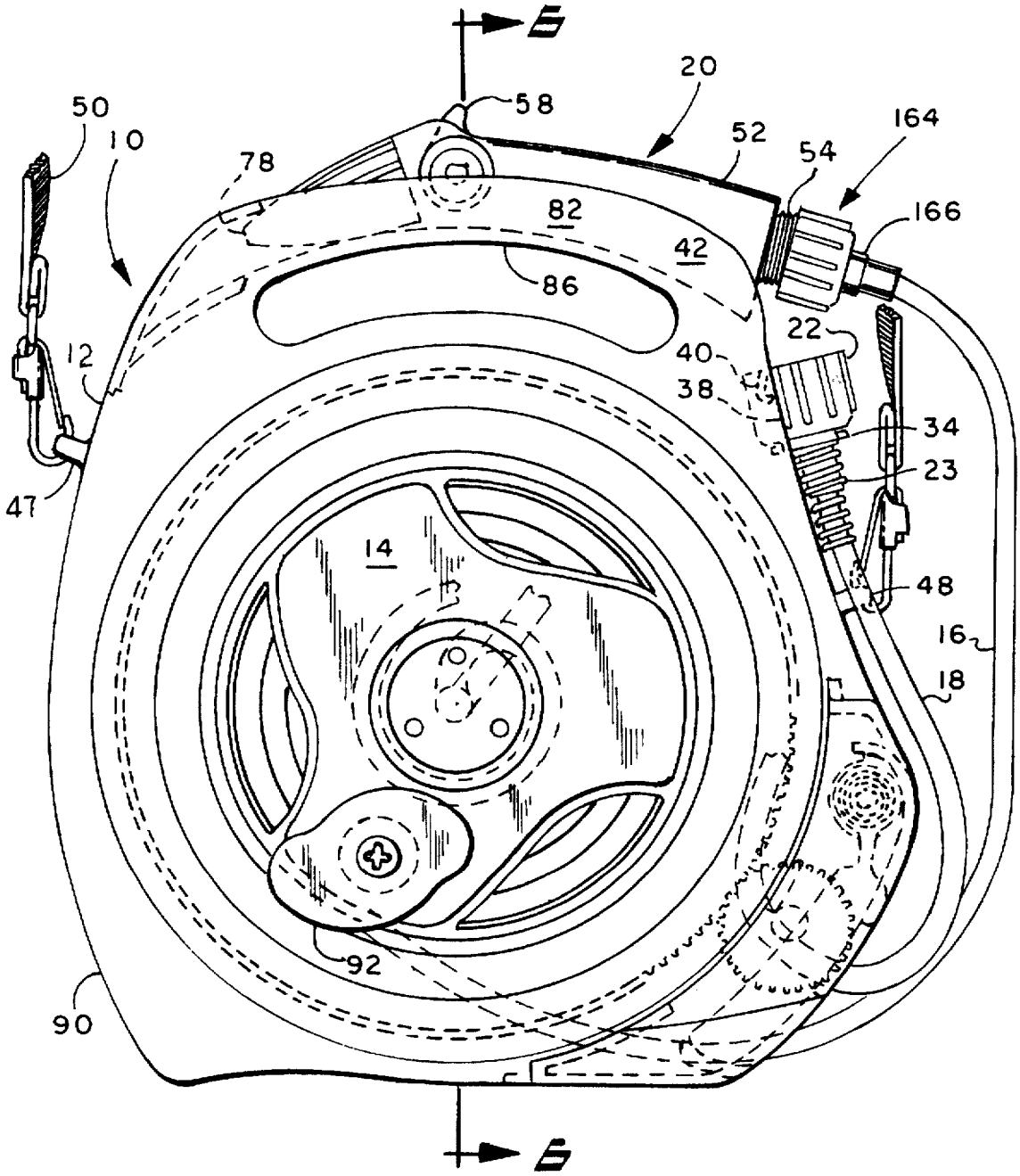
FIG. 1 is a plan view of the left side of a hose reel in accordance with the present invention.

The long hose 18 is shown fully wound upon the reel 14 in FIG. 1. The length of this hose can be up to 75 ft. With 75 ft. of hose, the entire assembly still weighs less than 10 lbs.

The ¼ in. inside diameter of the hose provides twice the flow of a 3/16 in. diameter hose while still keeping the weight of a long length of hose reasonable.

The hose 18 is easily disengaged from the aperture 38 and attached to a standard garden faucet by means of the connector 22. The garden watering tool 10 is then grasped by the handle 42 at the top of the housing 12 and the tool 10 carried to the location of use. Because the bearing support of the reel 14 is a low-friction bearing, the hose 18 easily unwinds as the user carries the tool away from the faucet.

The housing 12 is also provided with two openings 47, 48 for attachment of a shoulder strap 50.

Figure 2:
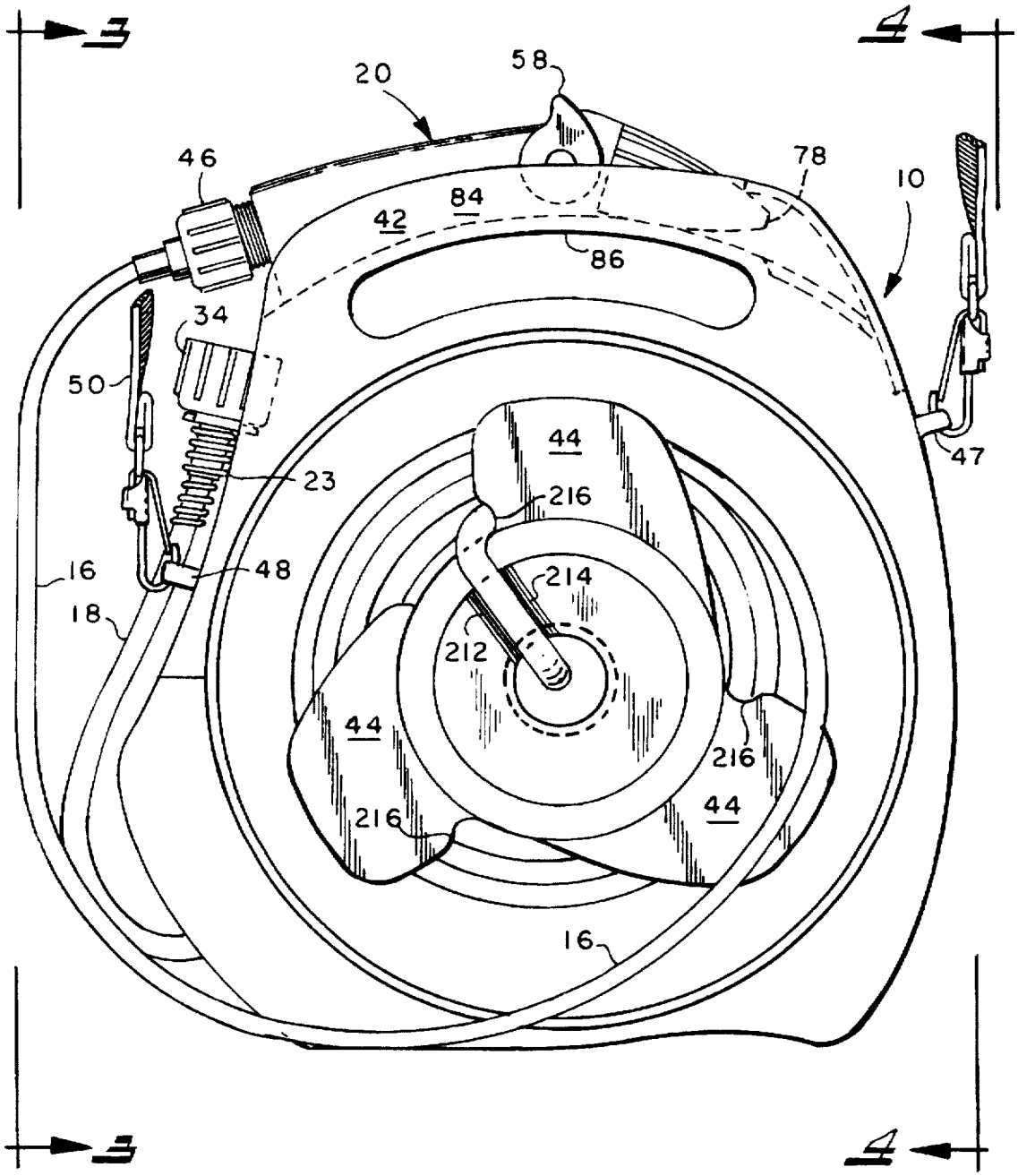
FIG. 2 is a plan view of the right side of the hose reel in FIG. 1.

Referring now to FIG. 2, the short hose 16 exits from the center of the right side of the housing 12 and is wound up around three horns 44 several times. The end of the short hose 16 is provided with a female hose connector 46. The connector 46 is identical to the connector 22 in all respects except it lacks the enlarged shoulder portion 34 used to hold the connector 22 in the aperture 38. The short hose 16 is between 5 and 8 ft. long. It is selected so that a user can carry the tool 10 to the location of use, disengage the nozzle 20 from the handle 42 and dispense water. The user has the option of dispensing water while holding on to the tool 10 or after setting the tool 10 down on a convenient surface such as a table or floor. The housing 12 has a flat bottom so the tool 10 is stable on a flat surface. With reference to FIG. 2, the short hose 16 is shown in its stored position wrapped around the horns 44. The horns 44 conveniently accommodate 8 ft. or more of the hose 16. The hose easily unwrapped from the horns 44 allowing one to use the nozzle 20 where desired.

Two ridges 212, 214, form a guide showing the user where to start winding the hose 16 around the horns 44. When winding is started at the guide, the nozzle 20 is received in the handle 42 with the correct amount of slack in the hose 16. Notches 216 at the bases of the horns 44 provide bending strain relief for the hose 16.

Referring now to FIG. 8, the nozzle 20 is shown exploded in greater detail. Water is admitted to the nozzle handle 52 through the male hose connector thread 54. The male thread part 54 is permanently attached to the handle 52. Near the front of the handle 52, two apertures are provided. The first aperture communicates with the nozzle handle outlet 56 while the second aperture holds the valve lever 58. The valve lever 58 has a control surface 60 easily accessed by the thumb of the hand holding the handle 52. The lever 58 rotates about an axis to open and close the aperture leading to the nozzle handle outlet 56. This is accomplished by means of a stud 62 having a kidney-shaped cross section which is offset from the axis around which the valve lever 58 rotates. An elastomeric cover 64 surrounds the stud 62. When the lever 58 is pushed back toward the hose connector 54, water may pass through the nozzle handle outlet 56. When the lever 58 is rotated forward, the stud 62 and the cover 64 are pressed against the aperture leading to the nozzle handle outlet 56 and the flow of water is interrupted. In this position, the pressure in the handle acts against the stud 62 helping to hold the valve closed. Leaking is thereby minimized. O-rings 66, 68 seal the valve mechanism in the handle.

A spray adjuster comprising a spray tip 72 and a spray tip adjustment cover 74 provides a means of adjusting the output of the nozzle 20 to be either a wide spray or a narrow stream. A tip O-ring 76 seals the spray tip adjustment cover 74 to the nozzle handle 52. Long narrow recesses 80 are provided on the sides of the nozzle handle 52. A lightweight easily adjusted nozzle with an on/off valve and adjustable spray is thus provided. Importantly, the nozzle is provided with a male hose thread 54 rather than the conventional female hose thread normally seen on a hose nozzle.

Figure 4:
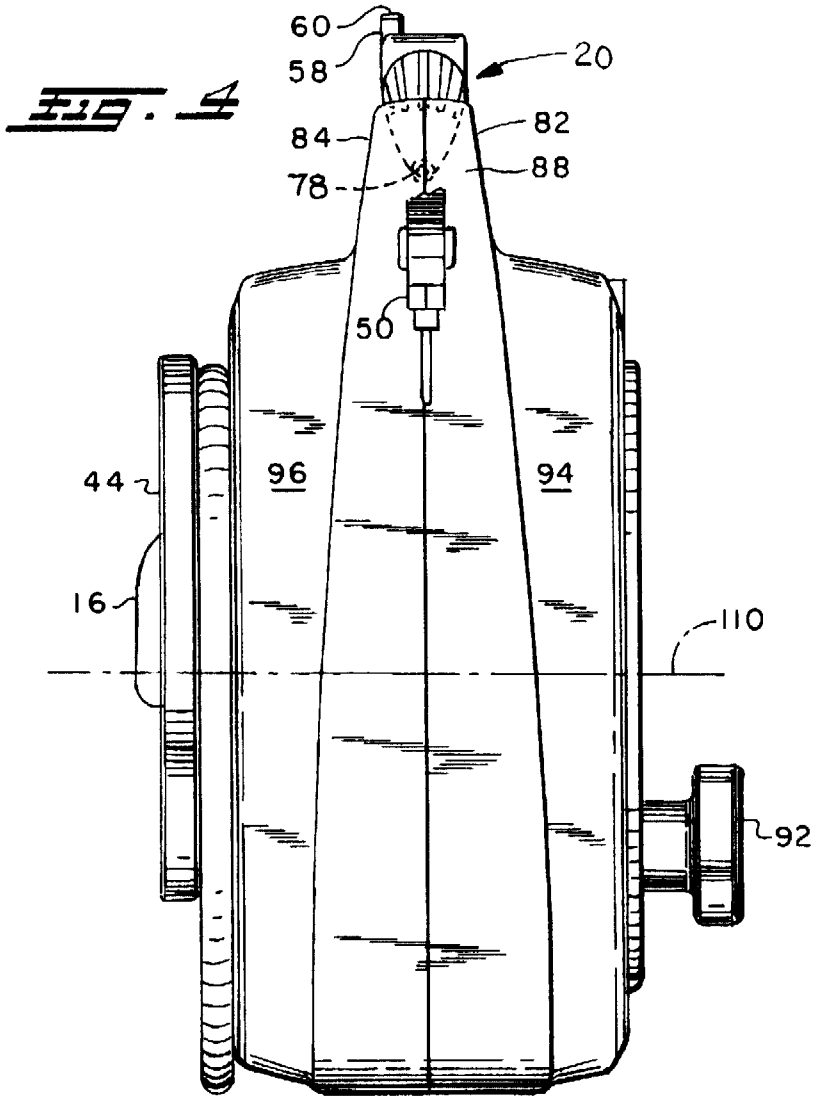
FIG. 4 is an end view of the front of the hose reel taken along line 4—4 of FIG. 2.

When one is finished with the nozzle 20, one rotates the lever 58 to its forward position and returns the nozzle to the top of the housing 12. As can be seen in FIGS. 1 and 2, the housing handle 42 is formed from two upstanding sidewalls 82, 84. The sidewalls are curved and interconnected across their bottom by a curved handle bottom wall 86 (Figure G). A tubular gripping surface having an open top is thereby provided. This tubular handle 42 also provides the holder for the nozzle 20. The very tops of the sidewalls 82, 84 are curved back toward one another. Portions of the tops of the sidewalls 82, 84 fit into the recesses 80 and provide a snap action holding the nozzle 20 in place when it is pushed down into the handle 42. When the nozzle 20 is placed in the handle 42, the tip of the nozzle 78 is contained within a closed portion of the housing defined by the two handle sidewalls 82, 84 and a handle forward wall 88 (FIG. 4). Should the valve lever 58 be accidentally actuated or should the valve open for any other reason, the forward wall 88 will prevent the nozzle from spraying water all over the adjacent area. Rather, any drips or streams emanating from the nozzle tip 78 will be deflected by the forward wall and drain out through apertures in the bottom of the housing 12.

Once the user has finished use of the nozzle 20 and placed it in the handle 42, he or she will often wish to retrieve the long hose 18. This is easily accomplished by holding the garden watering tool by the handle 42 so that the forward portion 9 faces the user. The crank handle 92 is then available for the right hand of the user to easily retrieve the long hose 18 by turning the crank handle 92 as one walks toward the faucet. The crank handle 92 is rotatably supported on the reel 14. The long hose take-up mechanism is correctly positioned to accept the hose and the nozzle tip 78 is shielded from the user preventing the unintentional spraying of oneself.

A number of elements of the garden watering tool 10 act together to make the retrieval of the long hose 18 easy.

Figure 5:
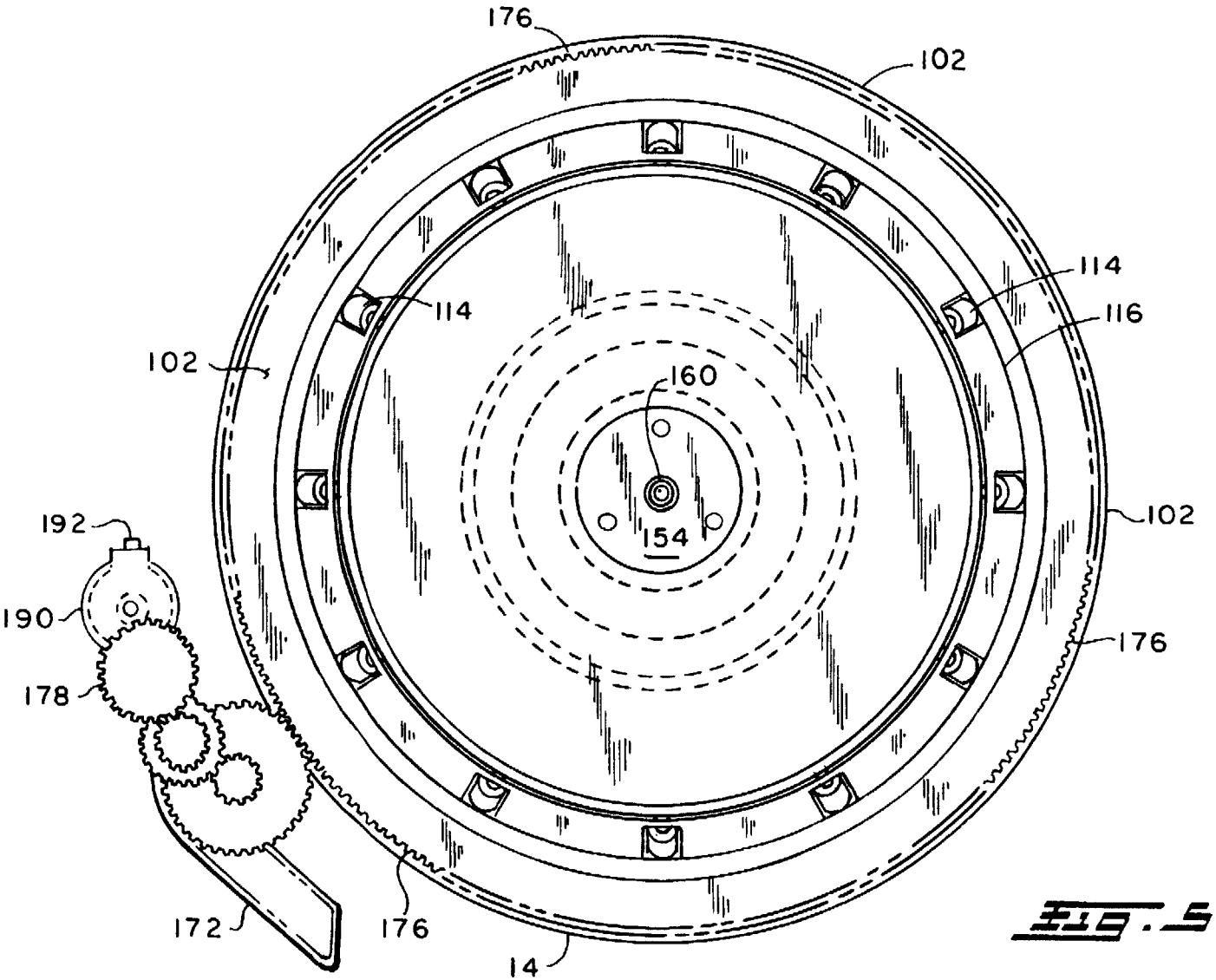
FIG. 5 is an internal detailed view of the right side of the reel, roller bearings, and race of the hose reel of FIGS. 1–4.
Figure 6:
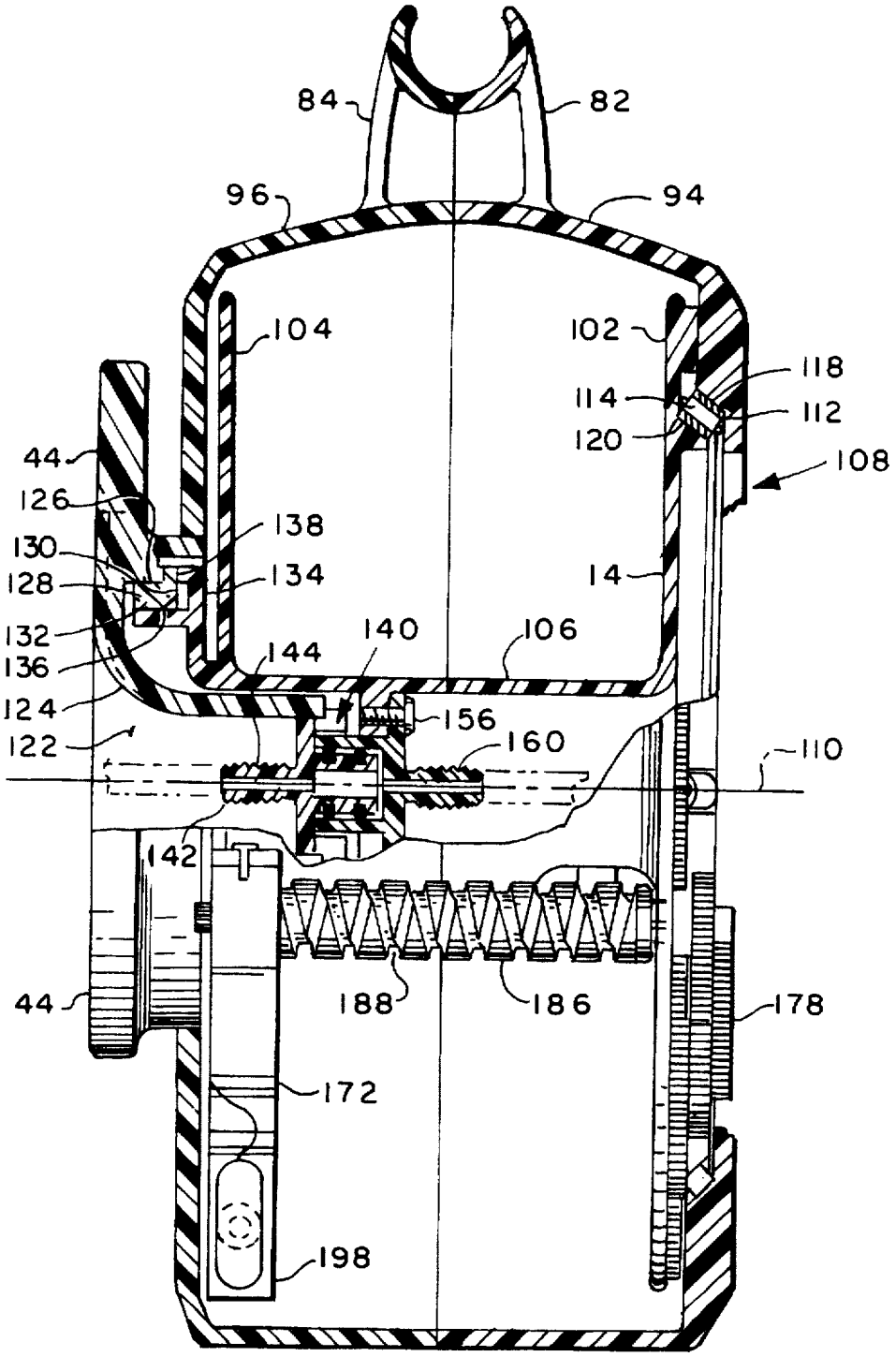
FIG. 6 is a cross section of the preferred embodiment of the invention taken along line 6—6 of FIG. 1.

Referring to FIG. 6, the garden watering tool 10 is shown in cross section. The housing 12 formed of two housing halves 94, 96. Each housing half 94, 96 is injection molded as an integral structure. The reel 14 comprises a pair of circular sidewalls 102, 104 and a central barrel portion 106. The sidewall 102 has the crank handle 92 (not seen in FIG. 6) fixed to it and will be referred to as the crank side sidewall. The crank side housing half 94 has a large central aperture 108 accommodating the crank handle 92 and allowing it to rotate around the axis 110 of the reel 14. A tapered roller bearing 112 supports and centers the crank side of the reel 102. One of the rollers 114 can be seen in cross section in FIG. 6. All of the identical rollers 114 can be seen in a side view in FIG. 5. The rollers 114 are contained in a cage 116 and bear against a frustoconical surface 118 in the crank side housing 94 and a second frustoconical surface 120 on the crank side reel sidewall 102. On the side of the housing 96 away from the crank handle 92, the reel 14 is supported in a different manner. A hollow central spindle 122 penetrates into the barrel 106 of the reel 14. The outboard end 124 of the spindle supports the horns 44 and also has an inwardly facing circular shoulder 126 coaxial with the axis of the spindle 110. A nylon bushing 128 is supported on the circular shoulder 126. The bushing has a circular surface 130 facing inwardly toward the reel 14 and a cylindrical surface facing axially inwardly toward the reel axis 110. The side of the reel facing the horns 44 has an outwardly extending bearing structure 134. The bearing structure 134 includes a cylindrical bearing surface 136 and a circular bearing surface 138. Thus, the horn side of the reel 14 is rotatably supported against the horn side of the housing 96 but prevented from moving axially or radially by the two bearing surfaces 130, 132 on the housing and the two bearing surfaces 136, 138 on the reel. As can be seen in FIG. 6, the cylindrical bearing surface 136 is somewhat larger in diameter than the barrel of the reel 106. This provides an enlarged bearing area for better support.

In FIG. 6, the housing half 96 is shown as one molded part while the horn structure and spindle 122 are shown as a second molded part. The spindle can just as easily be formed as part of the housing half 96. The horns 44 are then simply snapped onto the spindle bearing structure of the housing 96. The choice of how to break the housing into separate molded parts depends on molding preference.

The bearings described above provide a very low friction but stable support for the reel 106. Importantly, all of the bearing parts and surfaces are nonmetallic. They will not rust from the moisture inherent in a hose/reel environment. The bearing races and surfaces do not require machining.

The spindle 122 also supports the male half 142 of a rotating hose connection 140. The male half 142 includes an inner tubular member 144 extending outwardly along the reel axis 110. The short hose 16 (FIG. 9) fits over the threaded inner tubular element 144 and is held in place by a ferrule 146. The inboard portion of the male half of the connector 142 comprises a cylinder 148 coaxial with the reel axis 110 and having recesses accommodating two O-rings 150, 152. The male half of the connector can be fabricated from plastic or metal. The female half 154 of the rotatable hose connector 140 is supported on the reel 14 by means of screws 156 or the like. The female half 154 comprises a cylinder 158 having an inside diameter slightly larger than the outside diameter of the cylinder 148 of the male half. The cylinder 158 fits around the cylinder 148 and forms a water-tight rotatable seal in conjunction with the O-rings 150, 152. The long hose 18 is retained upon the female half 154 by means of a threaded inner tubular member 160 and a ferrule 162. The female half 154 can be fabricated from plastic or metal. The outside diameter of the cylinder 148 is kept small so that the bearing area between the O-rings 150, 152 and the cylinder 158 is small. Frictional forces are kept at a minimum. An inexpensive low-friction, water-tight, rotatable hose coupler is thereby provided. Referring to FIG. 9, the short hose 16 is terminated on the end away from the rotatable hose connection 140 by means of a female hose connector 164. The female hose connector 164 comprises a threaded inner tubular element 166 and a threaded cup 168 identical to the corresponding part in the female hose connector 22 on the end of the long hose 18. The outer tubular element 170 is identical to the outer tubular element of the long hose female hose connector except that it omits the enlarged shoulder portion 34. Such a shoulder portion is not required as the short hose 16 is never retained in the aperture 38.

Figure 3:
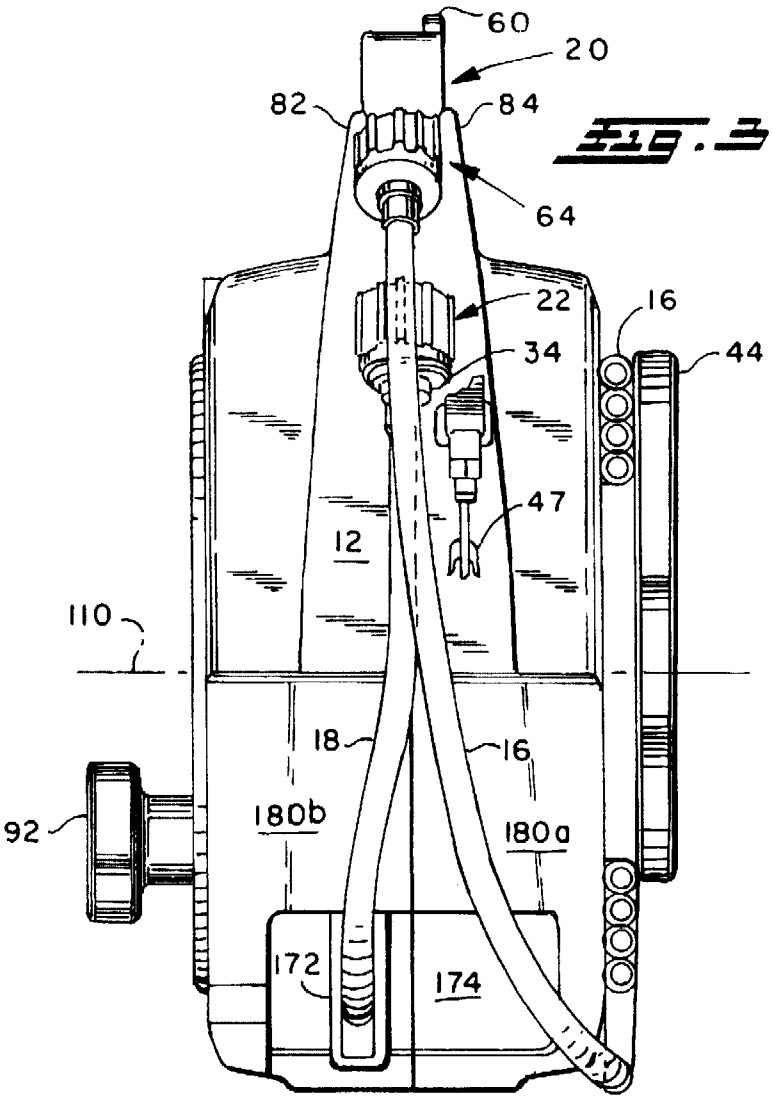
FIG. 3 is an end view showing the rear end of the hose reel of FIGS. 1 and 2 taken along the line 3—3 of the FIG. 2.
Figure 7:
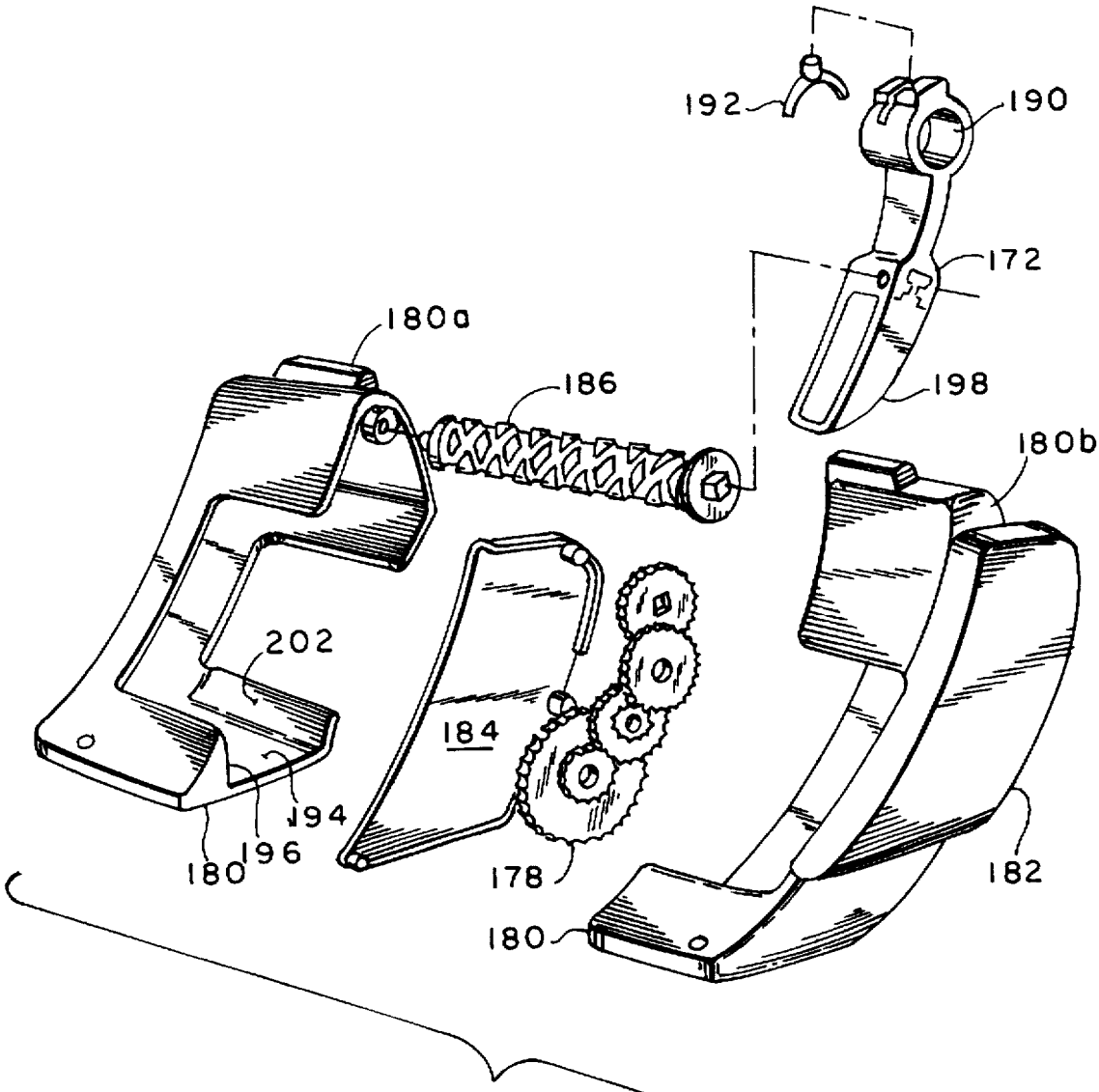
FIG. 7 is an exploded view showing the components of the hose positioning mechanism of the reel shown in FIGS. 1–6.
Figure 6:
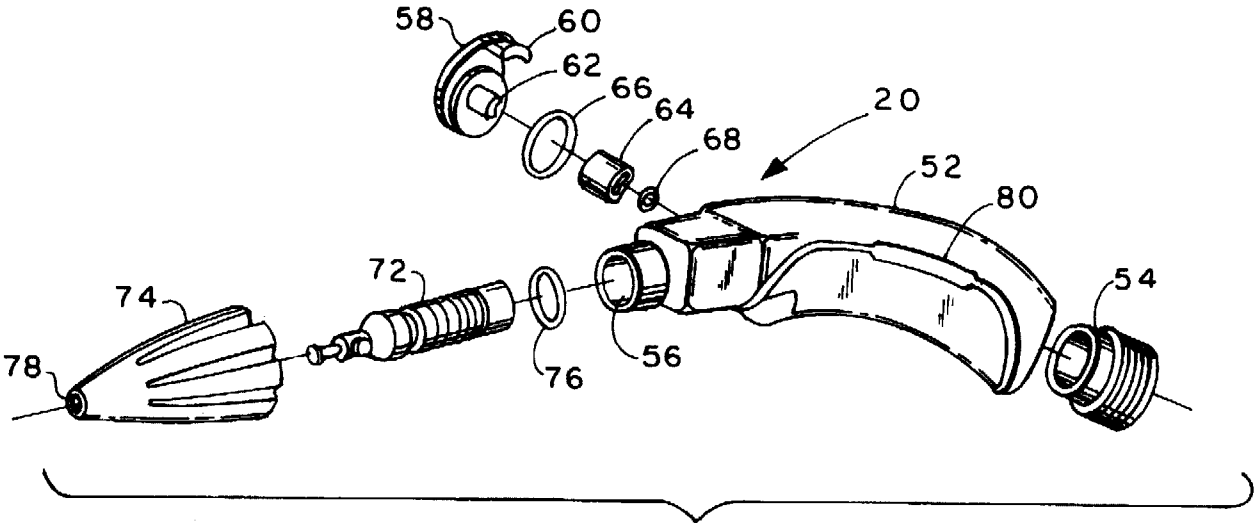
Figure 5:
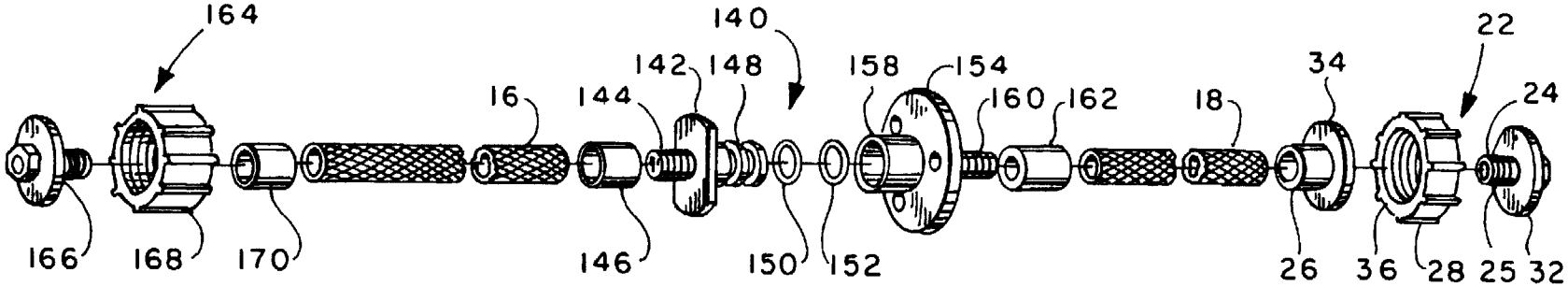

Referring to FIG. 3, the long hose 18 is shown in its position fully wound upon the reel 14. The hose 18 passes through a cross helix follower 172 in an aperture 174 near the bottom of the housing 12. The aperture 174 is generally as wide as the distance between the reel sidewalls 102, 104. The cross helix follower 172 is driven by a mechanism geared to the reel 14 and reciprocates laterally back and forth as the reel is operated. This assures that the long hose 18 is laid down upon the reel 14 in a manner to avoid binding, kinking, tangling, and the like which would interfere with the flow of water to the hose reeling or unreeling. The structure supporting and moving the follower 172 is best seen in FIGS. 5 and 7. Referring to FIG. 5, the outside edge of the crank sidewall 102 of the reel 14 is provided with gear teeth 176. The teeth 176 extend around the entire periphery crank sidewall 102 on a gear ring protruding from the outside surface of the sidewall 102. The sidewall 102 extends outwardly slightly beyond the gear teeth, protecting them and assuring alignment between the gear teeth 176 and the gear train 178. The gear teeth 176 on the reel 14 drive a gear train 178 consisting of several individual gears. As can be seen in FIG. 7, the gear train 178 is contained within a follower housing 180 which is assembled from two follower housing halves 180*a*, 180*b*. Within the follower housing 180, the gear train is further protected in a gear train compartment 182 closed by a gear train compartment wall 184. The last gear on the gear train 178 is mounted on the axis of a cross helix shaft 186. The cross helix shaft is rotatable within the lower housing 180 and has an endless helical groove 188 in its surface. Because of its connection to the gear train 178, the cross helix shaft 186 will rotate whenever the reel 14 rotates.

The cross helix follower 172 has a journal 190 at its top sized to fit around the cross helix shaft 186. A guide 192 fits in an aperture in the follower 172 and extends into the journal 190. The guide 192 rides in the groove 188 and causes the follower to reciprocate from side to side as the shaft 186 rotates. The guide is mounted in the follower 172 to allow it to twist and follow the path of the helical groove 188.

The bottom of the housing 180 has a lower surface 194 and a rearward surface 196 which loosely accommodate the bottom 198 of the follower 172 preventing it from twisting or being pulled into the reel. Similarly, a forward surface 202 on the follower housing 180 restrains the follower from being pulled out of the housing 12.

The invention has been described with reference to a preferred embodiment. Obviously, modifications and alterations will occur to others upon the reading and understanding of this specification and it is our intention to include such modifications and alterations insofar as they come within the scope of the appended claims.

Having thus described the invention, it is claimed:

1. A hose carrier comprising:

a housing having a top, a bottom, and a carrying handle;

a spool having a barrel portion rotatably supported in said housing;

a hose connector fixed to said barrel portion having a first nipple fixed with respect to said spool and a second nipple rotatable with respect to said spool and fixed with respect to said housing;

a relatively long length of hose contained on said spool having a first end fixed to said hose connection first nipple and a second end having fitting for connection to a standard garden faucet;

a relatively short length of hose having a first end connected to said hose connector second nipple and a second end connected to a nozzle;

said carrying handle being at said top of said housing and having a recess therein having an open top, an open end and a close end, said recess accepting said nozzle.

2. The hose carrier of claim 1, wherein said nozzle comprises a nozzle handle having a fluid passage with a first end connected to said second end of said short length of hose and a second end, a valve at said fluid passage second end and a spray tip connected to said valve.

3. The hose carrier of claim 2, wherein said recess closed end accepts and nozzle spray tip and deflects any spray from said tip.

4. The hose carrier of claim 3, wherein said valve is actuated by a thumb lever on said nozzle handle.

5. The hose carrier of claim 4, wherein said valve comprises an aperture communicating with said spray tip and a valve surface connected to said thumb lever closing said aperture in a closed position and opening said aperture in an open position.

6. The hose carrier of claim 5, wherein said valve surface is covered with a resilient elastomeric material.

7. The hose carrier of claim 6, wherein said valve surface is on a peg and said elastomeric material is a short length of tube covering said peg.

8. The hose carrier of claim 7, wherein said spray tip is adjustable to provide a stream or dispersed spray.

9. The hose carrier of claim 1, wherein said housing has a retainer accepting the second end of said long length of hose said retainer located near the top of said housing.

10. The hose carrier of claim 9, wherein said retainer is an aperture receiving said long length hose second end connector.

11. The hose carrier of claim 1, wherein said long length of hose has an internal diameter of approximately one quarter inch.

12. The hose carrier of claim 11, wherein said short length of hose has an internal diameter of approximately one quarter inch.

13. The hose carrier of claim 1 further comprising a follower fixed to said housing receiving said long length of hose and reciprocating laterally.

14. The hose carrier of claim 13 wherein said follower is carried on a shaft having a helical groove, said shaft being coupled to said spool whereby said shaft rotates when said spool rotates and said shaft causes said follower to reciprocate.

15. The hose carrier of claim 14, wherein said spool has a plurality of gear teeth near the spool periphery and said shaft is coupled to said spool by a gear train.

16. The hose carrier of claim 15, wherein said follower has an end remote from said shaft and said end is slidably supported against a generally flat surface preventing said end from being pulled out of said housing.

17. The hose carrier of claim 1, wherein said carrying handle is positioned on said housing top and comprises two spaced upstanding sidewalls having inwardly projecting protrusions and said nozzle has recesses accepting said protrusions when said nozzle is placed in said handle.

18. The hose carrier of claim 17, wherein said housing is provided with a retainer near said housing top holding said second end of said long length of hose near said top whereby water will not syphon out of said hose.

19. The hose carrier of claim 1, wherein said spool has a first sidewall having a first frustoconical surface facing said housing and said housing has a second frustoconical surface facing said spool first sidewall, said hose carrier further comprising a plurality of rollers retained within a frustoconical cage; and, said first frustoconical surface and said second frustoconical surface engage said rollers whereby said spool first sidewall is rotatably supported in said housing.

20. The hose carrier of claim 19, wherein said housing has an aperture surrounded by said second frustoconical surface and said spool first sidewall has a handle extending outwardly through said aperture allowing said spool to be manually rotated.

21. The hose carrier of claim 19, wherein said spool has a first bearing surface on the side of said spool opposite said first sidewall, said first bearing surface being supported in a bushing supported on said housing.

22. The hose carrier of claim 21, wherein said first bearing surface is cylindrical and said spool additionally comprises a second circular bearing surface engaging said bushing.

23. The hose carrier of claim 18, wherein said long length of hose second end fitting comprises a cylindrical threaded cup having an open end facing away from said hose end a closed end and a shoulder spaced from said cup closed end resiliently displaceable with reference to said cup closed end; and, said retainer comprises an aperture tightly accommodating said cup and said shoulder whereby said hose second end is releasably retained in said aperture.

24. A hose carrier comprising:

a housing having a top, a bottom, a carrying handle, a first sidewall having a central spindle supporting a first hose connector half and a first housing circular bearing portion surrounding said first sidewall central spindle, a second sidewall having a central opening and a second housing circular bearing portion surrounding said central opening;

a spool having a barrel portion, a first side wall and a second sidewall, said spool barrel portion supporting a second hose connector half mating with and rotatable with respect to said first hose connector half, said spool first sidewall having a first spool circular bearing portion rotatable against said first housing circular bearing portion, said spool second sidewall having a second spool circular bearing portion rotatable against said second housing circular bearing portion and a handle surrounded by said second spool circular bearing portion for rotating said spool with respect to said housing;

a relatively short length of hose having a first end connected to said second hose connector half and a second end; and, a relatively long length of hose having a first end connected to said first hose connector half and a second end, said long length of hose being received on said spool.

25. The hose carrier of claim 24, wherein said short length of hose end said long length of hose both have internal diameters of about one quarter inch.

26. The hose carrier of claim 25 further comprising a bearing race assembly holding a plurality of rollers, said bearing race assembly positioned between said second housing circular bearing portion and said second spool circular bearing portion forming a roller bearing.

27. The hose carrier of claim 26, wherein said bearing race is frustoconical, said second housing circular bearing portion is frustoconical and said second spool circular bearing portion is frustoconical.

28. The hose carrier of claim 27, wherein said first housing circular bearing portion comprises a circular surface and a cylindrical surface and said first spool circular bearing portion comprises a circular surface bearing against said housing circular surface and a cylindrical surface bearing against said housing cylindrical surface.

29. The hose carrier of claim 24 wherein said second end of said long length of hose is connected to a standard female hose connector and said second end of said short length of hose is connected to a standard female hose connector.

30. The hose carrier of claim 29, wherein a nozzle having a standard male hose connector is connected to the second end of said short length of hose, said nozzle being received in a receptacle in said housing.

31. The hose carrier of claim 30, wherein said receptacle is in said housing top and has a closed portion adapted to receive any drips from said nozzle.

32. The hose carrier of claim 31, wherein said housing has an aperture near its top, said aperture receiving said long length of hose second end.

33. The hose carrier of claim 32, wherein said long length of hose second end comprises a threaded cup having an open top, a closed bottom and a shoulder slightly spaced from said bottom and resiliently held parallel to said bottom, and said aperture has a top and a tab extending downwardly from said top whereby said long length of hose second end is held in said aperture by spring force generated by said shoulder urging said open top into engagement with said tab.

34. A garden watering tool comprising:

a housing having a top, a bottom, and a carrying handle at said top of said housing;

a spool having a barrel portion and two side walls rotatably support in said housing;

a hose connector fixed to said barrel portion having a first nipple fixed with respect to said spool and a second nipple with respect to said spool and fixed with respect to said housing;

a relatively long length of hose contained on said spool having a first end fixed to said hose connection first nipple and a second end having a female fitting for connection to a standard garden a relatively short length of hose having a first end connected to said hose connector second nipple and a second end connected to a female hose connector half; faucet;

a nozzle having a male hose connector half attached to said short length of hose and received in a recess in said housing top; and, said recess accepting said nozzle being in said carrying handle and having an open top and a closed end.

35. The garden watering tool of claim 34, wherein said nozzle comprises a nozzle handle having a fluid passage with a first end connected to said second end of said short length of hose and a second end, a valve at said fluid passage second end and a spray tip connected to said valve.

36. The garden watering tool of claim 35, wherein recess closed end accepts said nozzle spray tip.

37. The garden watering tool of claim 36, wherein said valve is actuated by thumb lever on said nozzle handle.

38. The garden watering tool of claim 37, wherein said valve comprises an aperture communicating with said spray tip and a valve surface connected to said thumb lever closing said aperture in a closed position and opening said aperture in an open position.

39. The garden watering tool of claim 38, wherein said valve surface is covered with a resilient elastomeric material.

40. The garden watering tool of claim 39, wherein said valve surface is on a peg and said elastomeric material is a short length of tube covering said peg.

41. The garden watering tool of claim 40, wherein said spray tip is adjustable to provide a stream or dispersed spray.

42. The garden watering tool of claim 34, wherein said housing has a retainer accepting the second end of said long length of hose, said retainer located near the top of said housing.

43. The garden watering tool of claim 42, wherein said retainer is an aperture receiving said long length hose second end connector.

44. A garden watering tool comprising:

a generally closed housing having a bottom, a top, and a carrying handle having a recess therein at said top;

a spool having a barrel portion and two side walls rotatably supported in said housing;

a hose connector fixed to said barrel portion having a first nipple fixed with respect to said spool and a second nipple rotatable with respect to said spool and fixed with respect to said housing;

a relatively long length of hose contained on said spool having a first end fixed to said hose connection first nipple and a second end adapted for connection to a standard garden faucet, said second end of said long length of hose exiting said housing through an opening near the bottom of said housing and being retained in a retainer near the top of said housing;

a relatively short length of hose having a first end connected to said hose connector second nipple and a second end connected to a nozzle, said nozzle being retained in said recess.

45. The garden watering tool of claim 44, wherein said recess has an open top, an open end and a closed end.

46. The garden watering tool of claim 44, further comprising a follower fixed to said housing at said opening near the bottom of said housing, said follower receiving said long length of hose and reciprocating laterally.

47. The garden watering tool of claim 46, wherein said spool has a handle by which said spool may be rotated and gear teeth near the periphery of one of said spool side walls, said gear teeth driving a shaft rotatably mounted to said housing, said shaft carrying said follower and causing said follower to reciprocate when said spool is rotated.

* * * * *